US012498146B2

(12) United States Patent
Shin et al.

(10) Patent No.: US 12,498,146 B2
(45) Date of Patent: Dec. 16, 2025

(54) REFRIGERATOR

(71) Applicant: SAMSUNG ELECTRONICS CO., LTD., Suwon-si (KR)

(72) Inventors: Dongwoo Shin, Suwon-si (KR); Hyunjoo Kim, Suwon-si (KR); Sung Han, Suwon-si (KR); Kwangsu Heo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 256 days.

(21) Appl. No.: 18/111,393

(22) Filed: Feb. 17, 2023

(65) Prior Publication Data

US 2023/0204263 A1 Jun. 29, 2023

Related U.S. Application Data

(63) Continuation of application No. PCT/KR2021/007960, filed on Jun. 24, 2021.

(30) Foreign Application Priority Data

Aug. 20, 2020 (KR) ..... 10-2020-0104436

(51) Int. Cl.
*F25B 21/02* (2006.01)
*F25D 15/00* (2006.01)

(52) U.S. Cl.
CPC ..... *F25B 21/02* (2013.01); *F25D 15/00* (2013.01); *F25B 2321/0251* (2013.01); *F25D 2323/00284* (2013.01)

(58) Field of Classification Search
CPC .. F25B 21/02; F25B 21/04; F25B 2321/0251; F25B 2321/0211; F25B 2321/0212;
(Continued)

(56) References Cited

U.S. PATENT DOCUMENTS 6,119,463 A * 9/2000 Bell ..... B60H 1/00471 62/3.61
6,295,820 B1 10/2001 Cauchy et al.
(Continued)

FOREIGN PATENT DOCUMENTS

EP 1 070 849 B1 3/2010
EP 1684022 B1 * 6/2017 ..... F24F 1/24
(Continued)

OTHER PUBLICATIONS

International Search Report dated Oct. 13, 2021 issued in PCT Application No. PCT/KR2021/007960.
(Continued)

*Primary Examiner* — Filip Zec
(74) *Attorney, Agent, or Firm* — STAAS & HALSEY LLP

(57) ABSTRACT

A refrigerator comprises a main body including a suction port and a plurality of discharge ports; a storage compartment formed inside the main body; a thermoelectric element to supply cold air to the storage compartment while discharging heat generated; a heat sink receiving the heat from the thermoelectric element; a blowing fan below the heat sink to cool the heat sink; and a scroll housing to accommodate the blowing fan, the scroll housing including an inlet through which air from the suction port to the blowing fan. The scroll housing includes a linear portion which forms a part of the inlet, the linear portion is formed perpendicular to the flow direction of air passing through the heat sink, and air that has passed through the blowing fan is respectively discharged in several directions through the plurality of discharge ports.

20 Claims, 12 Drawing Sheets

(58) Field of Classification Search
CPC ..... F25B 2321/023; F25B 2500/19; F25B 2600/11; F25B 2700/02; F25B 2700/2104; F25B 47/02; F25D 17/062; F25D 2317/0661; F25D 11/00; F25D 17/06; F25D 21/06; F25D 21/08; F25D 23/003; F25D 23/006; F25D 2317/0651; F25D 2317/066; F25D 2317/0665; F25D 2317/0671; F25D 2317/0672; F25D 2323/0026; F25D 2323/00274; F25D 2500/02; F25D 2700/12
See application file for complete search history.

(56) References Cited

U.S. PATENT DOCUMENTS

| | | | | |
|---|---|---|---|---|
| 6,345,507 | B1 * | 2/2002 | Gillen | F25B 21/04 136/203 |
| 6,688,379 | B2 | 2/2004 | Huang et al. | |
| 6,779,348 | B2 | 8/2004 | Taban | |
| 7,443,670 | B2 * | 10/2008 | Nishi | F04D 29/4226 361/695 |
| 7,802,617 | B2 * | 9/2010 | Hwang | G06F 1/20 165/122 |
| 7,827,806 | B2 * | 11/2010 | Tuszkiewicz | F25B 21/02 62/3.6 |
| 7,887,290 | B2 * | 2/2011 | Chen | F04D 29/663 415/206 |
| 7,907,403 | B2 * | 3/2011 | Malone | F04D 25/14 165/104.33 |
| 7,909,571 | B2 * | 3/2011 | Wu | F04D 29/4213 415/206 |
| 7,987,898 | B2 * | 8/2011 | Meng | F04D 29/582 165/104.34 |
| 9,857,108 | B2 | 1/2018 | Höjer et al. | |
| 9,909,789 | B2 * | 3/2018 | Brija | A47F 10/06 |
| 10,473,345 | B2 * | 11/2019 | Edwards | F24F 5/0042 |
| 10,704,812 | B2 | 7/2020 | Kim et al. | |
| 11,035,378 | B2 * | 6/2021 | Ke | F04D 29/4226 |
| 11,041,663 | B2 | 6/2021 | Oh et al. | |
| 11,156,395 | B2 | 10/2021 | Oh et al. | |
| 11,300,331 | B2 | 4/2022 | Choi et al. | |
| 11,597,905 | B2 * | 3/2023 | Oram | C12M 41/48 |
| 11,993,132 | B2 * | 5/2024 | Pacilli | B60H 1/00807 |
| 12,249,857 | B2 * | 3/2025 | Chen | H01M 10/482 |
| 2004/0083740 | A1 | 5/2004 | Taban | |
| 2008/0030949 | A1 * | 2/2008 | Hsiao | G06F 1/203 361/689 |
| 2018/0340142 | A1 * | 11/2018 | Liu | C12M 41/14 |
| 2019/0169572 | A1 * | 6/2019 | Shi | C12M 23/42 |
| 2022/0333842 | A1 | 10/2022 | Oh et al. | |

FOREIGN PATENT DOCUMENTS

| | | |
|---|---|---|
| EP | 3 699 528 A1 | 8/2020 |
| JP | 5-118725 | 5/1993 |
| JP | 10-252682 | 9/1998 |
| JP | 11-94423 | 4/1999 |
| JP | 2000-127740 | 5/2000 |
| JP | 2001-41630 | 2/2001 |
| JP | 3186119 | 7/2001 |
| JP | 2003-003998 | 1/2003 |
| JP | 3361405 | 1/2003 |
| JP | 2006-207578 | 8/2006 |
| JP | 2007-285164 | 11/2007 |
| JP | 4706305 | 6/2011 |
| JP | 2011-244999 | 12/2011 |
| JP | 4978267 | 7/2012 |
| JP | 6128490 | 5/2017 |
| JP | 2017-106659 | 6/2017 |
| KR | 10-0336132 | 5/2002 |
| KR | 20-0330444 | 10/2003 |
| KR | 20-0336132 | 12/2003 |
| KR | 10-0526606 | 11/2005 |
| KR | 10-0905037 | 6/2009 |
| KR | 10-2016-0065231 | 6/2016 |
| KR | 10-1820793 | 1/2018 |
| KR | 10-2018-0106767 | 10/2018 |
| KR | 10-2018-0106898 | 10/2018 |
| KR | 10-2019-0111563 | 10/2019 |
| KR | 10-2020-005008 | 1/2020 |
| KR | 10-2084106 | 3/2020 |
| KR | 10-2274676 | 7/2021 |

OTHER PUBLICATIONS

Written Opinion dated Oct. 13, 2021 issued in PCT Application No. PCT/KR2021/007960
European Search Report dated Nov. 15, 2023 issued in European Application No. EP 21 85 8462
European Search Report dated Feb. 2, 2024 issued in European Application No. EP 21 85 8462
Office Action dated Sep. 15, 2025 issued in Korea Application No. 10-2020-0104436.
Office Action dated Jul. 4, 2025 issued in Chinese Application No. 202180050582.2.
Office Action dated Sep. 3, 2025 issued in European Application No. 21 858 462.1.

* cited by examiner

REFRIGERATOR

CROSS-REFERENCE TO RELATED APPLICATION

This application is a continuation application, under 35 U.S.C. § 111(a), of International Application No. PCT/KR2021/007960, filed on Jun. 24, 2021, which is based on and claims priority under 35 U.S.C. § 119 to Korean Patent Application No. 10-2020-0104436, filed on Aug. 20, 2020 in the Korean Intellectual Property Office, the disclosure of which is incorporated by reference herein in its entirety.

BACKGROUND

Field

The present disclosure relates to a refrigerator, and more specifically, to a refrigerator having an improved heat dissipation structure.

Description of the Related Art

In general, a refrigerator is an apparatus that includes a storage compartment and a cold air supply device for supplying cold air to the storage compartment to keep food fresh.

DESCRIPTION OF THE RELATED ART

The temperature of the storage compartment is maintained within a certain range required to keep food fresh.

The storage compartment of the refrigerator is provided with a front side that is open, and the open front side is closed by a door to maintain the temperature of the storage compartment at normal times.

The inside of the storage compartment is kept at the temperature by cold air supplied by a cold air supply device, and in a small refrigerator, the cold air supply device may be provided as a thermoelectric element. A small refrigerator may be provided to store small items, such as wine.

The thermoelectric element has two sides, and while consuming electric energy according to the direction of current, transfer heat from one side to the opposite side.

Accordingly, one side of the thermoelectric element is provided to absorb heat and supply cold air to the storage compartment while the opposite side is provided to discharge heat and have a high temperature. Therefore, when heat dissipation of the thermoelectric element is not sufficiently performed, cooling efficiency may be lowered.

In addition, as a blower for heat dissipation provided at one side of a thermoelectric element, an axial fan is generally used, but in such an axial fan, the flow rate may be rapidly reduced when the flow path has a high resistance. In addition, when a centrifugal fan is used for a blower, space limitations exist and a lot of noise may be generated.

SUMMARY

A refrigerator according to an embodiment includes: a main body including a suction port and a plurality of discharge ports; a storage compartment formed inside the main body; a thermoelectric element to supply cold air to the storage compartment while discharging heat generated, the thermoelectric element including a heat absorbing portion for supplying cold air and a heat generating portion for discharging the heat; a heat sink configured to receive the heat from the thermoelectric element; a blowing fan below the heat sink to cool the heat sink; and a scroll housing to accommodate the blower fan, the scroll housing including an inlet through which air from the suction port to the blower fan, wherein the scroll housing includes: a linear portion forming a part of the inlet, the linear portion is formed perpendicular to a flow direction of air passing through the heat sink, and the air passed through the blowing fan is respectively discharged in multiple directions through the plurality of discharge ports.

In addition, the scroll housing may further include a round portion connected to the linear portion, and the linear portion and the round portion are provided to form the inlet.

In addition, each of the linear portion and the round portion may be provided as a pair.

In addition, a length from a center of the inlet to the round portion may be a first length, a minimum length from the center of the inlet to the linear portion may be a second length, and a difference between the first length and the second length may be provided to be smaller than or equal to 12% of the first length.

In addition, the heat sink may include a plurality of heat dissipation fins, and the linear portion may be formed in a direction perpendicular to a direction in which the heat dissipation fins are disposed.

In addition, the suction ports may be provided as a pair and the pair of suction ports are formed at opposite side surfaces, respectively, of a lower portion of the main body.

In addition, the scroll housing may further include a heat sink support rib extending upward from an upper surface of the scroll housing.

In addition, the linear portion may be formed to be convexly bent upward to guide an air flow to the blowing fan.

In addition, the blowing fan may be a centrifugal fan.

In addition, the plurality of discharge ports may include a first discharge port formed on a rear surface of the main body, and a second discharge port formed on a bottom surface of the main body.

In addition, the scroll housing may include: a first outlet formed at a rear side of the scroll housing to communicate with the first discharge port; and a second outlet formed on a lower side of the scroll housing to communicate with the second discharge port, and wherein the air introduced into the inlet of the scroll housing may be discharged through the first outlet and the second outlet and then to the first discharge port and the second discharge port, respectively.

In addition, the heat sink may be a first heat sink and the blowing fan may be a first blowing fan, the refrigerator further including: a second heat sink above the thermoelectric element to receive cold air; and a second blowing fan above the second heat sink to diffuse cold air into the storage compartment, and wherein the first heat sink may be below the thermoelectric element.

In addition, the refrigerator may further include: a circuit board mounting portion in front of the scroll housing; and a seating plate coupled to the circuit board mounting portion, wherein a circuit board may be accommodated in the circuit board mounting portion.

In addition, the main body may further include a circuit board cover forming a part of the bottom surface and below the circuit board mounting portion, the scroll housing may further include an outlet formed at a front side, wherein air from the outlet of the scroll housing may flow into a space between the seating plate and the circuit board cover to cool heat generated from the circuit board.

The plurality of discharge ports may include a first discharge port and a second discharge port, and the circuit board mounting portion may further include a third discharge port formed on a lateral side to discharge the air having cooled the circuit board.

A refrigerator according to an embodiment includes: a main body having a suction port through which external air is introduced; a storage compartment formed in the main body; a thermoelectric element having heat exchanged to supply the storage compartment with cold air, the thermoelectric element including a heat absorbing portion for supplying cold air and a heat generating portion for discharging the heat; a heat sink to receive heat from the thermoelectric element; a blowing fan to below the heat sink to cool the heat sink; and a scroll housing to accommodate the blowing fan, the scroll hosing having a plurality of discharge flow paths formed therein, wherein the plurality of discharge flow paths includes a first flow path provided to allow air to flow to a first discharge port formed on a rear surface of the main body, a second flow path to allow air to flow to a second discharge port formed on a bottom surface of the main body, and a third flow path to allow air to flow to a third discharge port formed on a front lower portion of the main body to cool a circuit board when the circuit board is accommodated in front of the scroll housing.

In addition, the refrigerator may further include a seating plate on which the circuit board is seated, the seating plate in front of the scroll housing, the main body may further include a circuit board cover disposed below the seating plate while forming a part of the bottom surface, wherein air flows from the scroll housing to a space between the seating plate and the circuit board cover to form the third flow path.

In addition, the scroll housing may include an outlet provided on a front side thereof to form the third flow path.

In addition, the scroll housing may include: an inlet formed on an upper surface thereof to allow air from the suction port to flow to the blowing fan; and a linear portion forming a part of the inlet, the linear portion extending in a direction perpendicular to a flow direction of air passing through the heat sink.

In addition, the scroll housing may further include a round portion connected to the linear portion to form the inlet, in which a length from a center of the inlet to the round portion may be a first length, a minimum length from the center of the inlet to the linear portion may be a second length, and a difference between the first length and the second length may be smaller than or equal to 12% of the first length.

DETAILED DESCRIPTION

Figure 1:
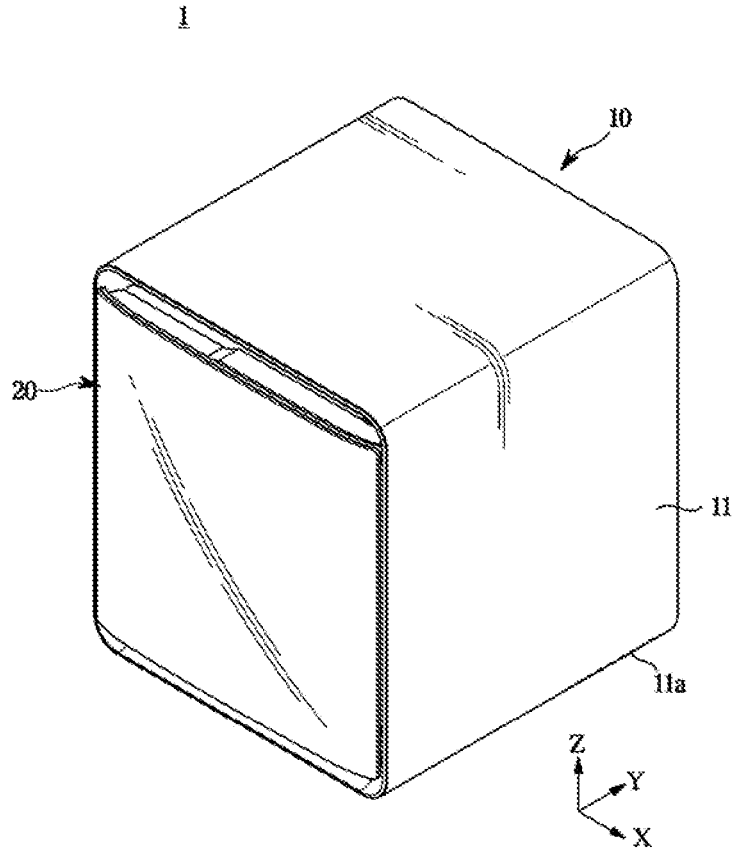
FIG. 1 is a perspective view illustrating a refrigerator according to an embodiment of the disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Hereinafter, embodiments according to the disclosure will be described in detail with reference to the accompanying drawings.

An embodiment of the disclosure provides a refrigerator having an improved heat dissipation structure.

An embodiment the disclosure provides a refrigerator capable of increasing the efficiency of a blowing fan by minimizing generation of vortices during intake of external air.

A linear portion is formed at an inlet of a scroll housing to minimize, vortices generated at the inlet during intake of air, so that noise can be reduced.

A discharge port through which heat-exchanged air is discharged is formed in plural to increase the flow rate of air, so that a dissipation fin can be effectively dissipated.

A flow path is formed in a compact structure in which heat of a dissipation fin is cooled while cooling heat generated from a circuit board, so that the space utilization of a storage compartment can be increased.

Figure 2:
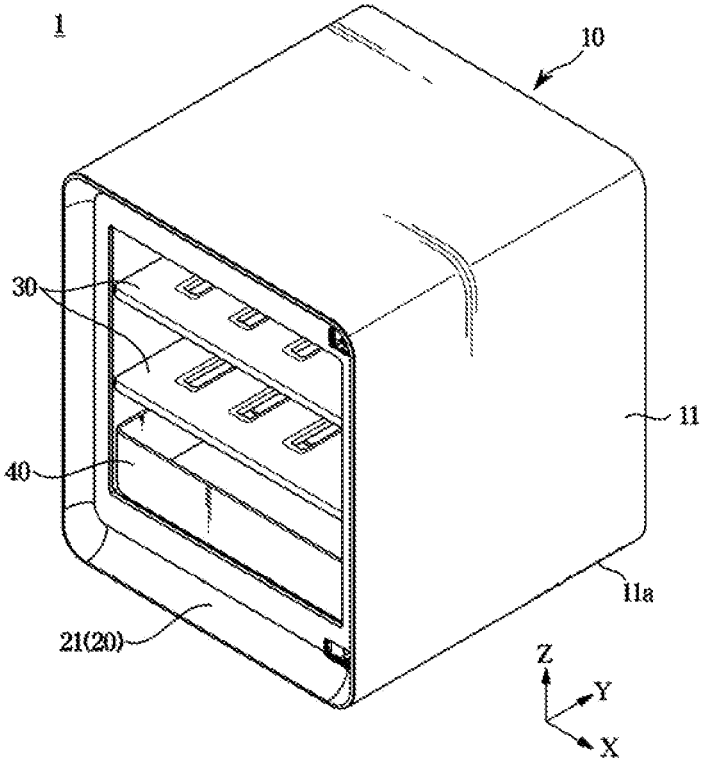
FIG. 2 is a perspective view illustrating the refrigerator shown in FIG. 1, in which a door is removed.
Figure 3:
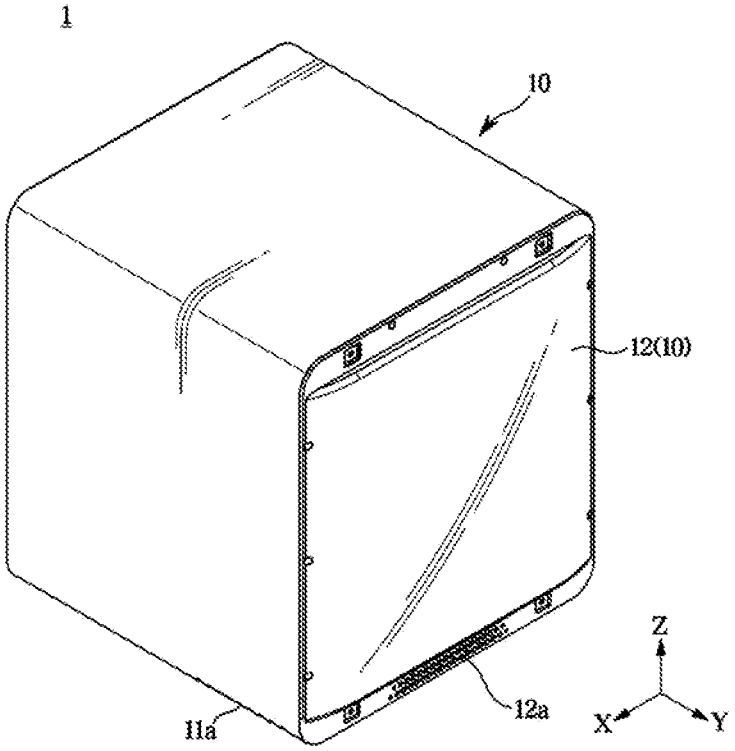
FIG. 3 is a perspective view illustrating the refrigerator shown in FIG. 1, which is viewed from the rear.
Figure 4:
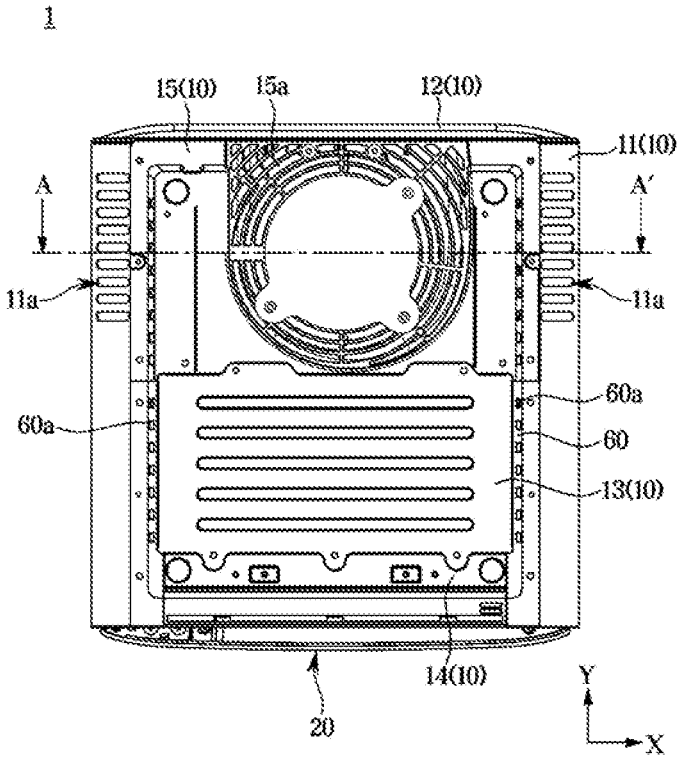
FIG. 4 is a front view illustrating a bottom surface of the refrigerator shown in FIG. 1.
Figure 5:
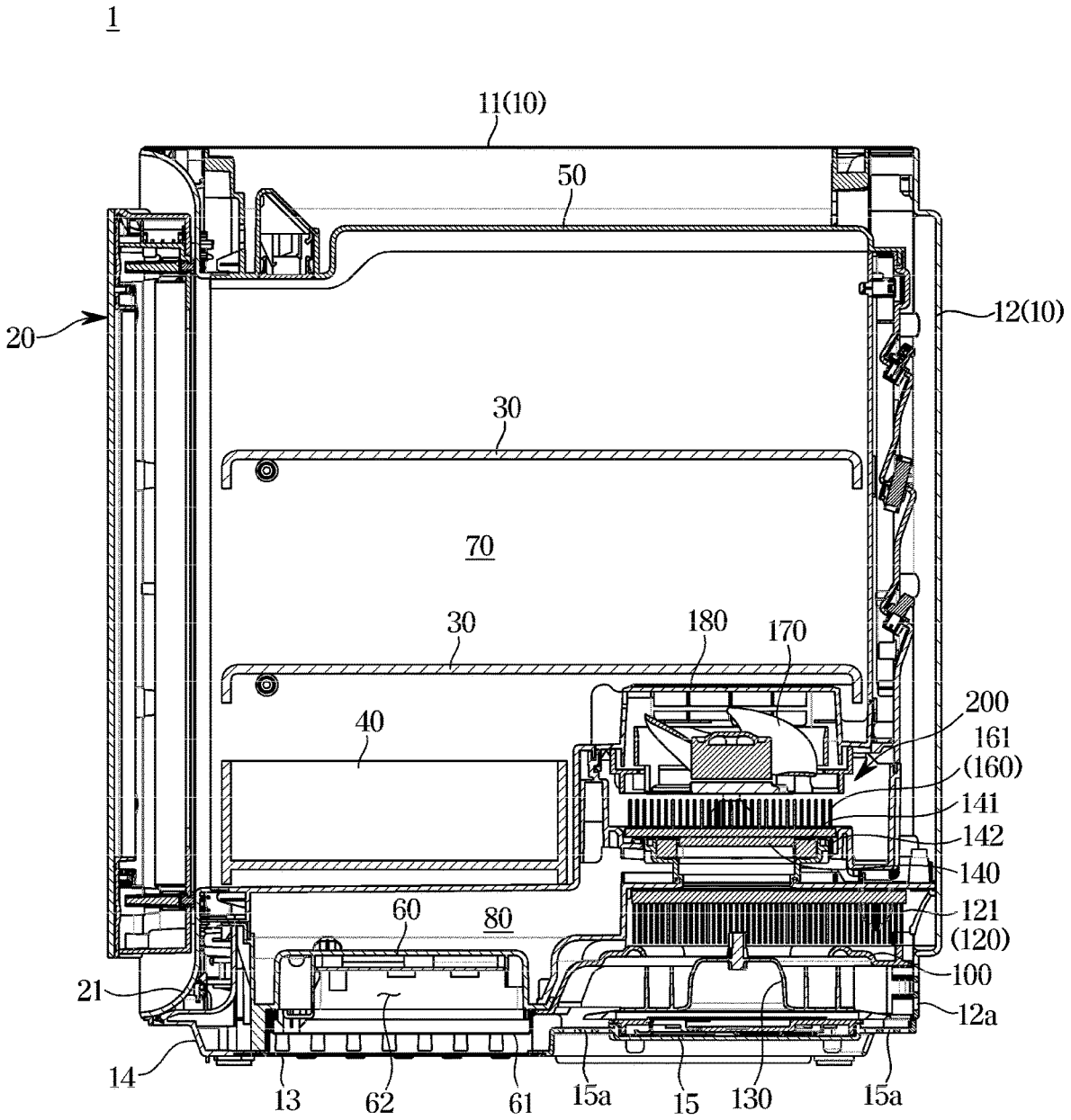
FIG. 5 is a cross-sectional view of the refrigerator shown in FIG. 1.

FIG. 1 is a perspective view illustrating a refrigerator according to an embodiment of the disclosure. FIG. 2 is a perspective view illustrating the refrigerator shown in FIG. 1, in which a door is removed. FIG. 3 is a perspective view illustrating the refrigerator shown in FIG. 1, which is viewed from the rear. FIG. 4 is a front view illustrating a bottom surface of the refrigerator shown in FIG. 1. FIG. 5 is a cross-sectional view of the refrigerator shown in FIG. 1.

Referring to FIGS. 1 to 5, a refrigerator 1 may include a main body 10, a storage compartment 70, and a door 20 for opening or closing the storage compartment 70. The main body 10 may be provided to form the external appearance of the refrigerator 1. The storage compartment 70 may be formed inside the main body 10 to have a front side that is openable. The door 20 may be rotatably coupled to the main body 10 to open or close the open front side of the storage compartment 70.

The main body 10 may include a side panel 11 and a rear panel 12 forming the external appearance. In addition, the main body 10 may include an inner case 50 forming the storage compartment 70. A heat insulating material (not shown) may be foamed between the inner case 50 and an outer case to prevent cold air from leaking from the storage compartment 70. In addition, the main body 10 may include a door frame 21 coupled to the front of the side panel 11. The door frame 21 may be provided to seat the door 20 thereon.

The storage compartment 70 may be provided inside thereof with a plurality of shelves 30 and storage containers 40 on which items may be placed.

Referring to FIG. 3, the rear panel 12 may be coupled to the rear of the side panel 11. The rear panel 12 may be provided with a first discharge port 12*a*. Details thereof will be described below.

Referring to FIG. 4, the main body 10 may include a circuit board cover 13 and a blowing fan cover 15. The circuit board cover 13 and the blowing fan cover 15 may form the bottom surface of the main body 10. The circuit board cover 13 may be disposed in front of the blowing fan cover 15 and coupled to the blowing fan cover 15.

The circuit board cover 13 and the blowing fan cover 15 may be coupled to the side panel 11. In addition, the main body 10 may include a front panel 14. The front panel 14 may be coupled to the front of the circuit board cover 13 to form one side of a front lower portion of the main body 10.

The side panel 11 may be provided with a suction port 11*a*. The suction port 11*a* may be provided in a pair. The suction ports 11*a* may be formed in a rear lower portion of the refrigerator 1. That is, the suction ports 11*a* may be formed in opposite sides, respectively, of a lower portion of the main body 10.

In addition, the blowing fan cover 15 may include a second discharge port 15*a*. The refrigerator 1 may include a circuit board mounting portion 60 provided on the upper side of the circuit board cover 13. The circuit board mounting portion 60 may include a third discharge port 60*a*. The third discharge port 60*a* may be formed on a lateral side of the circuit board mounting portion 60. Details thereof will be described below.

Referring to FIG. 5, the inner casing 50 of the refrigerator 1 may be provided to divide the storage compartment 70 from a machine compartment 80. More specifically, the storage compartment 70 may be provided on the upper side of the inner case 50 and the machine compartment 80 may be provided on the lower side of the inner case 50.

In addition, the inner case 50 is provided to be partially opened at a lower side in a rear portion, so that a cold air discharge frame 180 provided to discharge cold air may be coupled to the open portion. Through this, with respect to the inner case 50 and the cold air discharge frame 180, the upper side may be considered the storage compartment 70 and the lower side may be considered the machine compartment 80.

The machine compartment 80 has a cooling assembly 200 disposed at one side thereof that is configured to generate cold air and supply the cold air to the inside of the storage compartment 70 while releasing hot air to the outside. More specifically, the cooling assembly 200 may be disposed at a lower rear portion of the machine compartment 80. Detailed configuration of the cooling assembly 200 will be described below.

The refrigerator 1 may further include a circuit board mounting portion 60 and a seating plate 61. The circuit board mounting portion 60 and the seating plate 61 may be disposed in front of the cooling assembly 200. In other words, the circuit board mounting portion 60 may be disposed in front of a scroll housing 100 to be described below. The seating plate 61 may be coupled to the circuit board mounting portion 60. The circuit board mounting portion 60 and the seating plate 61 may form an accommodation space 62 for accommodating a circuit board (not shown). That is, the circuit board mounting portion 60, the circuit board (not shown), and the seating plate 61 may be disposed at a front lower portion of the machine compartment 80.

In order to cool the circuit board (not shown), air is forced to flow through the seating plate 61 and the circuit board cover 13, so the seating plate 61 may be formed of a material for effectively transferring heat generated from the circuit board (not shown).

The cooling assembly 200 may include a thermoelectric element 140. The refrigerator 1 according to an embodiment of the disclosure is provided to perform cooling using the thermoelectric element 140. In general, the thermoelectric element 140 is not suitable for design a large product by its nature, and the cooling using the thermoelectric element 140 is performed in a small refrigerator. Therefore, as an embodiment of the disclosure, a wine refrigerator among small refrigerators will be described as an example. However, the use of the refrigerator may not be limited thereto, and may be variously changed as long as cooling is performed using the thermoelectric element 140.

The thermoelectric element 140 is a cooling device that generates a heat flux between two materials junctions. The thermoelectric element 140 may have two surfaces, and in response to a DC current flowing through the thermoelectric element 140, transmit heat from one surface to the other surface, so that heat absorption and heat generation occur. In the case of the refrigerator 1 of the disclosure, the upper side of the thermoelectric element 140 may be formed as a heat absorbing part and the lower side of the thermoelectric element 140 may be formed as a heat generating portion.

Figure 6:
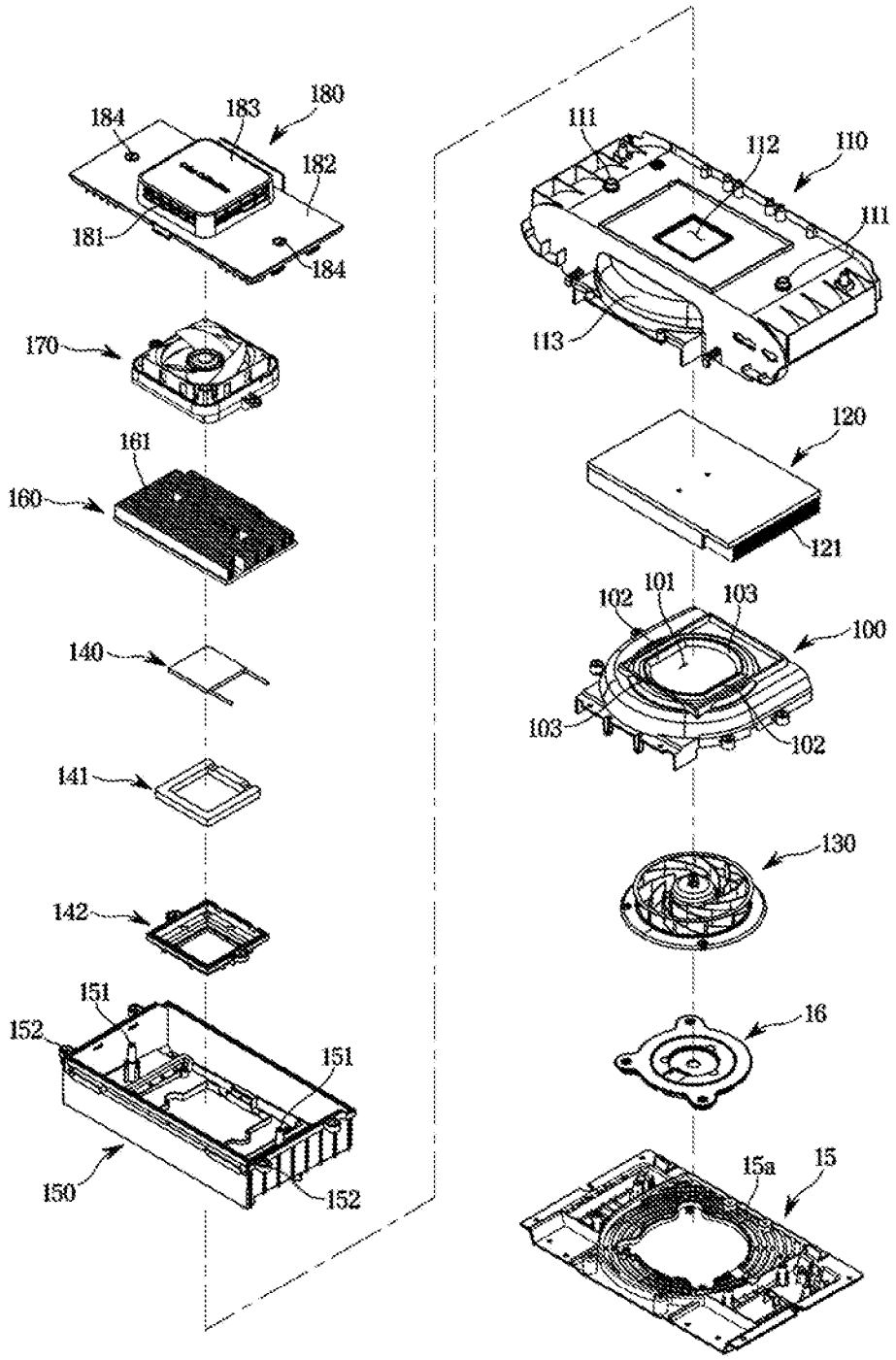
FIG. 6 is an exploded perspective view illustrating a cooling assembly and a blowing fan cover of a refrigerator according to an embodiment of the disclosure.

FIG. 6 is an exploded perspective view illustrating a cooling assembly and a blowing fan cover of a refrigerator according to an embodiment of the disclosure.

Referring to FIGS. 5 and 6, the cooling assembly 200 may be disposed on the upper side a blowing fan cover 15 in a sequential manner.

The refrigerator 1 may include a blowing fan cover 15 and a blowing fan seating portion 16. The refrigerator 1 may include a first blowing fan 130, a scroll housing 100, a first heat sink 120, and a first frame 110.

The blowing fan mounting portion 16 may be coupled to the blowing fan cover 15.

A blowing fan may be coupled to the upper side of the blowing fan mounting portion 16. The blowing fan according to an embodiment of the disclosure may be provided as a centrifugal fan. The blowing fan may be driven by a driving device, such as a separate motor (not shown).

The scroll housing 100 may be provided to accommodate the blowing fan. The scroll housing 100 may be mounted above the blowing fan. The scroll housing 100 may include an inlet 101 at a central portion to allow air to flow from the suction port 11*a* to the blowing fan. Details of the shape of the inlet 101 formed in the scroll housing 100 will be described below.

The first heat sink 120 may be disposed above the scroll housing 100. The first heat sink 120 may include a heat dissipation fin 121. The heat dissipation fin 121 may be formed in plural.

The first frame 110 may be provided to accommodate all of the first heat sink 120, the scroll housing 100, and the first blowing fan 130. Therefore, the first frame 110 may be provided in a box shape with an open lower side.

The first frame 110 may include first coupling portions 111 provided on both sides of the upper surface thereof. The first coupling portion 111 is provided to allow a coupling protrusion (not shown) formed at a lower portion of a second frame 150 to be inserted thereinto so that the first frame 110 is coupled to the second frame 150.

The first frame 110 may include a thermoelectric element arrangement hole 112 formed in a central portion. The thermoelectric element 140, while disposed in the thermoelectric element arrangement hole 112, may supply heat to the first heat sink 120 provided at a lower side thereof.

The first frame 110 may include a scroll cover portion 113 having a shape corresponding to a front portion of the scroll housing 100 disposed below. The scroll cover portion 113 and the scroll housing 100 are provided to be spaced apart from each other such that a rear end of the circuit board mounting portion 60 may be fixed therebetween.

The refrigerator 1 may include a second frame 150 and a thermoelectric element 140. In addition, the refrigerator 1 may include a thermoelectric element mounting portion 141 for fixing the thermoelectric element 140 and a thermoelectric element mounting frame 142 on which the thermoelectric element mounting portion 141 is seated.

The second frame 150 may include second coupling portions 151 provided on inner opposite sides thereof. The second coupling portions 151 may be provided to extend upward from the inner surface of the second frame 150. The second coupling portion 151 may be coupled to a cold air discharge frame 180, to be described below, by a separate coupling member.

The second frame 150 may include a protrusion inserting portion 152 extending outward from a side surface thereof. In FIG. 6, the protrusion inserting portion 152 is illustrated as four protrusion inserting portions, but the number thereof may not be limited thereto. The protrusion inserting portion 152 is provided to allow a protrusion extending from a lower surface of the inner case 50 toward the machine compartment 80 to be inserted thereinto. Through this, the second frame 150 and the inner wound 50 may be coupled to each other.

The second frame 150 has a substantially box shape with an open upper surface and may accommodate the thermoelectric element 140, the thermoelectric element mounting portion 141, and the thermoelectric element mounting frame 142. The second frame 150 may be mounted on an upper portion of the first frame 110 such that the thermoelectric element 140 may be disposed between the second frame 150 and the first frame 110.

The refrigerator 1 may include a second heat sink 160. The second heat sink 160 may be disposed above the thermoelectric element 140. The second heat sink 160 may be accommodated inside the second frame 150. The second heat sink 160 may include a heat dissipation fin 161. The heat dissipation fin 161 may be provided in plural.

The refrigerator 1 may include a second blowing fan 170. The second blowing fan 170 may be disposed above the second heat sink 160. The second blowing fan 170 may be provided as an axial flow fan. The second blowing fan 170 may be disposed above the second heat sink 160 to diffuse cold air into the storage compartment 70.

The refrigerator 1 may include a cold air discharge frame 180. The cold air discharge frame 180 may be provided to accommodate a part of the upper portion of the blowing fan.

The cold air discharge frame 180 may include a body 182 provided to be in contact with the inner case 50 of the main body 10. The cold air discharge frame 180 may include an accommodating portion 183 extending upward from the body 182. A portion of the blowing fan may be disposed inside the accommodating portion 183.

The accommodating portion 183 may be provided in a substantially quadrangular shape to protrude upward from the body 182. A plurality of cold air discharge holes 181 may be formed on a side surface of the accommodating portion 183 so that cold air induced from the blowing fan may move into the storage compartment 70.

The body 182 of the cold air discharge frame 180 may be provided with a third coupling portion 184. The third coupling portion 184 may be coupled to the second coupling portion 151 of the second frame 150 through a separate coupling member. Through this, the cold air discharge frame 180 and the second frame 150 may be coupled to each other.

The thermoelectric element 140 of the refrigerator 1 according to the disclosure is provided to take heat from the upper part of the thermoelectric element 140 and supply heat to the lower part of the thermoelectric element 140. That is, the upper part of the thermoelectric element 140 may be provided as a heat absorbing portion for supplying cold air, and the lower part of the thermoelectric element 140 may be provided as a heat generating portion for discharging heat.

The second heat sink 160 disposed on the upper part of the thermoelectric element 140 is cooled with the heat removed by the thermoelectric element 140, and cold air generated from the cooled second heat sink 160 may be caused to flow by the second blowing fan 170. The air flown by the second blowing fan 170 may move to the cold air discharge frame 180 disposed above the second blowing fan 170. Thereafter, the cooled air may move through the cold air discharge hole 181 formed in the cold air discharge frame 180 into the storage compartment 70, in which manner cold air may be supplied to the storage compartment 70.

On the other hand, the first heat sink 120 disposed below the thermoelectric element 140 may be heated with heat supplied from the thermoelectric element 140. The first blowing fan 130 provided to suction external air and discharge the suctioned air to cool the heated first heat sink 120 may be disposed below the first heat sink 120. The first blowing fan 130 may be accommodated in the scroll housing 100.

Through the scroll housing 100 having the inlet 101, external air may smoothly flow to the first blowing fan 130 and airflow loss may be minimized. Details regarding the shape of the inlet 101 of the scroll housing 100 will be described below.

Therefore, the first blowing fan 130, the scroll housing 100, the first heat sink 120, and the first frame 110 may be provided as a heat generating portion, and the second heat sink 160, the second blowing fan 170, and the second frame 150 may be provided as a heat absorbing portion. In this case, the heat generating portion may refer to a portion that receives heat from the thermoelectric element 140, and the heat absorbing portion may refer to a portion from which heat is removed by the thermoelectric element 140. Hereinafter, a flow path related to a heat dissipation structure provided to dissipate heat generated from the heat generating portion to the outside will be described.

Figure 7:
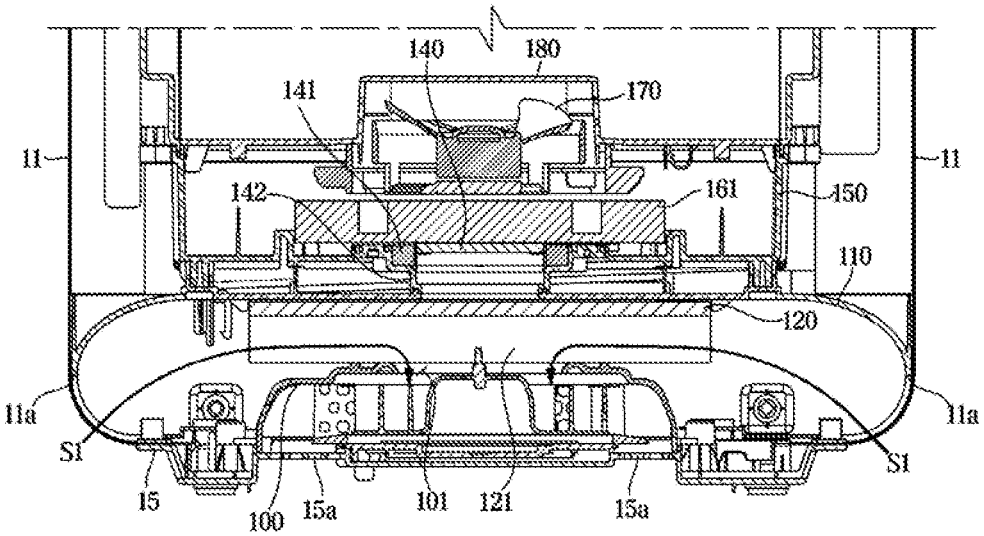
FIG. 7 is a cross-sectional view taken along line A-A' of FIG. 4, showing a suction flow path.
Figure 8:
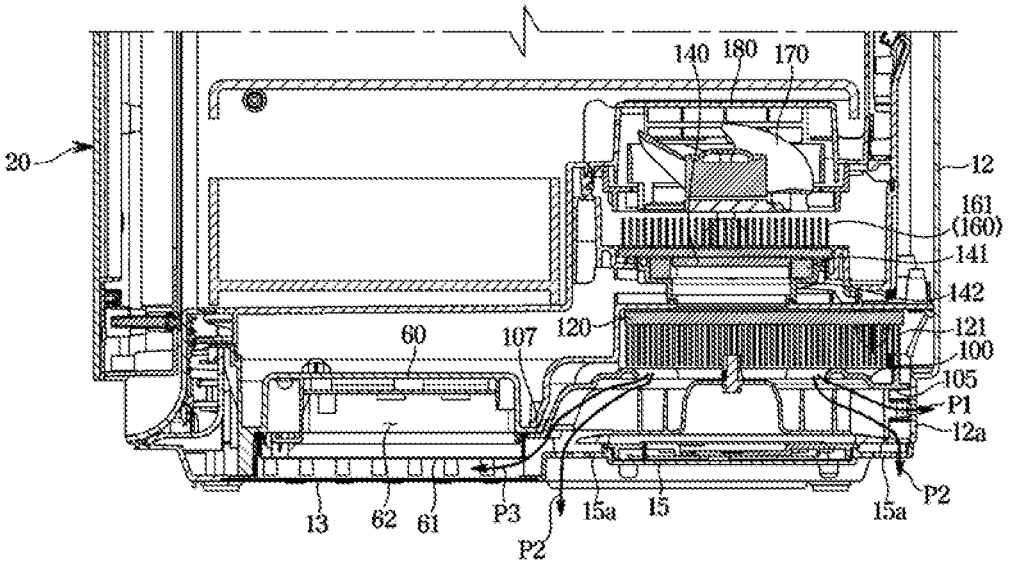
FIG. 8 is a view illustrating a plurality of discharge flow paths of a refrigerator according to an embodiment of the disclosure.
Figure 9:
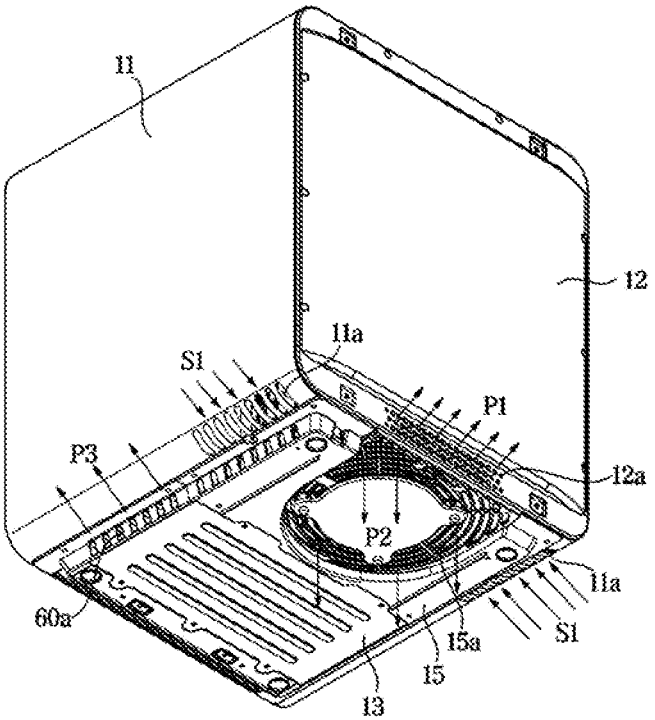
FIG. 9 is a view illustrating a suction flow path and a plurality of discharge flow paths of a refrigerator according to an embodiment of the disclosure.

FIG. 7 is a cross-sectional view taken along line A-A' of FIG. 4, showing a suction flow path. FIG. 8 is a view illustrating a plurality of discharge flow paths of a refrigerator according to an embodiment of the disclosure. FIG. 9 is a view illustrating a suction flow path and a plurality of discharge flow paths of a refrigerator according to an embodiment of the disclosure.

Referring to FIGS. 4 and 7, external air may be introduced from suction ports 11*a* formed on the opposite sides of the lower portion of the side panel 11. Such an air flow may be generated by the first blowing fan 130. The air introduced by the first blowing fan 130 may pass between the plurality of heat dissipation fins 121 formed on the first heat sink 120 to cool the heat dissipation fins 121 heated by the thermoelectric element 140. The air having heat exchanged with the first heat sink 120 may be introduced into the inlet 101 of the scroll housing 100 and then exit to the outside. Accordingly, the refrigerator 1 may include a suction flow path 51, which is a flow of air introduced from the suction port 11*a*, passing through the heat dissipation fins 121 of the first heat sink 120, to enter the inlet 101 of the scroll housing 100. Air passing through the suction flow path 51 may flow in the same direction as the direction in which the heat dissipation fins 121 of the first heat sink 120 are disposed. In other words, the air may flow from an outer side to an inner side along the left-right direction of the refrigerator 1.

Referring to FIG. 8, the refrigerator 1 may include a plurality of discharge flow paths P1, P2, and P3. Air introduced into the inlet 101 of the scroll housing 100 through the suction flow path 51 may flow along the plurality of discharge flow paths P1, P2, and P3. The scroll housing 100 may be provided to form the plurality of discharge flow paths P1, P2, and P3.

The plurality of discharge flow paths P1, P2, and P3 may include a first flow path P1, a second flow path P2, and a third flow path P3. The first flow path P1 may be provided to allow air to flow to the first discharge port 12*a* formed on the rear surface of the main body 10. The second flow path P2 may be provided to allow air to flow to the second discharge port 15*a* formed on the bottom surface of the main body 10. The third flow path P3 may be provided to allow air to flow to the third discharge port 60*a* formed on a front lower portion of the main body 10.

More specifically, the third flow path P3 may be provided to allow air to flow from a third outlet 107 of the scroll housing 100, which will be described below, into a space between the seating plate 61 and the circuit board cover 13. Through this, heat generated from a circuit board (not shown) disposed on the upper side of the seating plate 61 may be cooled. The air having heat exchanged with the circuit board may be discharged to the outside through the third discharge port 60*a*.

Specifically, the first discharge port 12*a* may be formed on a lower portion of the rear panel 12, the second discharge port 15*a* may be formed on the blowing fan cover 15, and the third discharge port 60*a* may be formed on the circuit board mounting portion 60. The suction port 11*a*, the first discharge port 12*a*, the second discharge port 15*a*, and the third discharge port 60*a* are shown in detail in FIG. 9.

As shown in FIG. 9, external air may be introduced into the refrigerator 1 through the suction ports 11*a* formed on the opposite lower sides of the side panel 11. The air introduced and heat-exchanged with the first heat sink 120 may flow through the inlet 101 of the scroll housing 100 into the first blowing fan 130.

The air flowing along the first flow path P1 may be discharged to the outside through the first discharge port 12*a* formed in the rear panel 12.

The air flowing along the second flow path P2 may be discharged to the outside through the second discharge port 15*a* formed in the blowing fan cover 15.

The air flowing along the third flow path P3 may be moved between the seating plate 61 and the circuit board cover 13 to cool the circuit board (not shown), and then discharged to the outside through the third discharge ports 60*a* formed on the opposite sides of the circuit board mounting portion 60. As shown in FIG. 9, the opposite sides of the circuit board mounting portion 60 may be provided to be in contact with the circuit board cover 13 and exposed to the outside.

In FIG. 9, the third discharge ports 60*a* are illustrated as being formed on the opposite sides of the circuit board mounting portion 60, that is, on lower opposite sides of the main body 10 and thus air is discharged to the lateral sides. However, the location of the third discharge port 60*a* may not be limited thereto. For example, the location of the third discharge port 60*a* may be changed to the front side of the front panel 14.

In the heat dissipation structure, the discharge port for discharging air having heat exchanged with heat dissipation fins is provided in plural, through which a flow rate of air cooling the heat generating portion of the thermoelectric element 140 is increased, so that the heat dissipation fins may be more effectively dissipated.

In addition, since the circuit board is disposed in front of the heat generating portion so as to cool the heat generated from the circuit board while cooling the heat generated from the heat dissipation fins, so that the flow path may be formed in a compact structure. Through this, space utilization of the storage compartment 70 may be increased.

Figure 10:
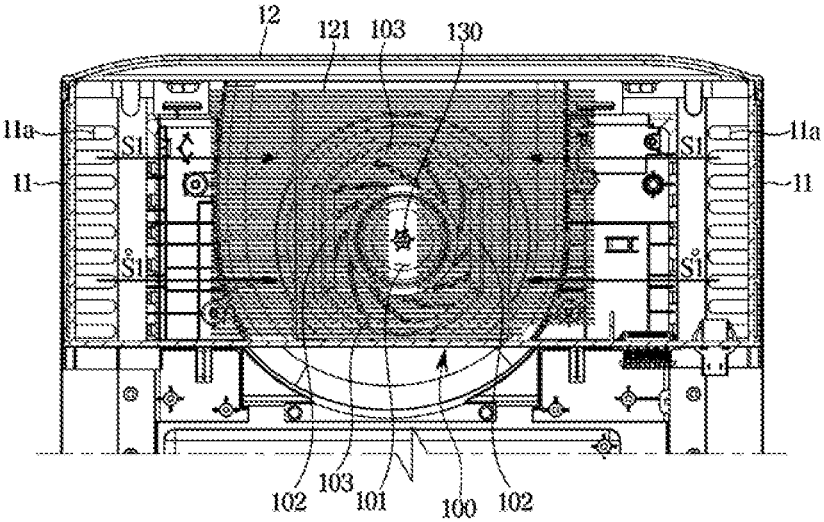
FIG. 10 is a view illustrating a refrigerator according to an embodiment of the disclosure, viewed from the top while a part is cut.
Figure 11:
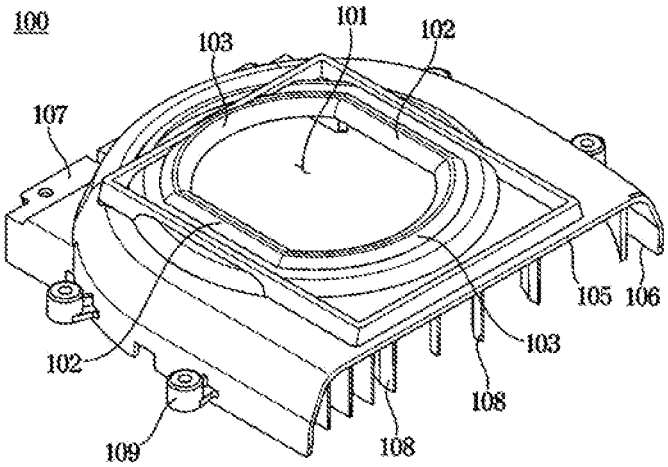
FIG. 11 is a perspective view illustrating a scroll housing of a refrigerator according to an embodiment of the disclosure.
Figure 12:
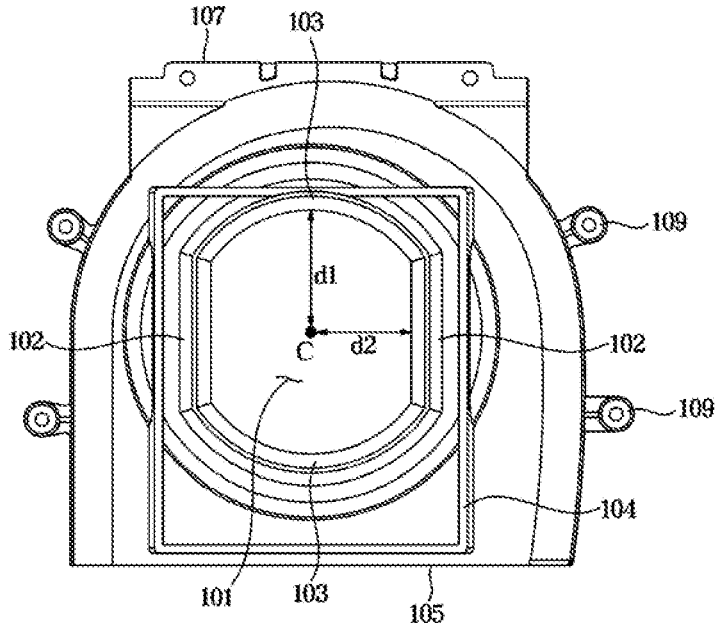
FIG. 12 is a front view illustrating a scroll housing of a refrigerator according to an embodiment of the disclosure.

FIG. 10 is a view illustrating a refrigerator according to an embodiment of the disclosure, viewed from the top while a part is cut. FIG. 11 is a perspective view illustrating a scroll housing of a refrigerator according to an embodiment of the disclosure. FIG. 12 is a front view illustrating a scroll housing of a refrigerator according to an embodiment of the disclosure.

Referring to FIG. 10, the first heat sink 120 may be disposed above the scroll housing 100. More specifically, the plurality of heat dissipation fins 121 formed on a lower side of the first heat sink 120 may be disposed.

Air introduced into the inside through the suction ports 11*a* formed on the opposite sides of the side panel 11 may flow in the same direction as the direction in which the plurality of dissipation fins 121 are disposed. That is, the suction flow path S1 may be formed in the same direction as the extending direction of the plurality of heat dissipation fins 121. In other words, it may be formed in the same direction as the direction in which air from the suction port 11*a* passes through the first heat sink 120.

The scroll housing 100 may be disposed below the first heat sink 120. The first blowing fan 130 may be disposed below the scroll housing 100. The air introduced through the suction port 11*a* may flow into the first blowing fan 130 through the inlet 101 of the scroll housing 100. In this case, the centers C of the first blowing fan 130 and the scroll housing 100 may be disposed to be coincide with each other.

Referring to FIGS. 10 and 11, the scroll housing 100 may include an inlet 101, a linear portion 102, and a round portion 103.

The linear portion 102 and the round portion 103 may be connected to each other to form the inlet 101. Each of the linear portion 102 and the round portion 103 may be provided in a pair.

The linear portion 102 may be formed perpendicular to the flow direction of air passing through the first heat sink 120. In other words, the linear portion 102 may be formed in a direction perpendicular to the direction in which the plurality of heat dissipation fins 121 of the first heat sink 120 are disposed.

In addition, the linear portion 102 may be formed to be bent convexly upward to smoothly guide the flow of air to the blowing fan.

In general, the inlet 101 of the scroll housing 100 is provided in a circular shape identical to the shape of a fan. However, in this case, there is a concern that flow resistance and noise may increase due to generation of vortices along the flow direction of air.

The inlet 101 formed in the scroll housing 100 of the refrigerator 1 according to the disclosure may not be provided in a circular shape but may include the linear portion 102, thereby minimizing vortices from being generated in the air flowing through the inlet 101 toward the first blowing fan 130. In particular, in the refrigerator 1 according to the disclosure, the suction ports 11*a* are formed on the lower opposite sides so that air flows in one direction. Accordingly, the linear portions 102 are provided to be extend in a direction perpendicular to the air flow direction at two locations adjacent to the suction ports 11*a*.

Therefore, with such a structure, the vortices in the suction flow path S1 may be minimized, so that the flow resistance may be reduced and noise caused by the centrifugal fan may be reduced.

The scroll housing 100 may further include a heat sink support rib 104. The heat sink support rib 104 may be provided in a substantially quadrangular shape at an outside of the inlet 101. The heat sink support rib 104 may be provided to extend upward from the upper surface of the scroll housing 100.

Through the heat sink support rib 104, a gap between the plurality of heat sink fins 121 of the first heat sink 120 and the scroll housing 100 is minimized, so that the air introduced into the suction port 11*a* may be caused to flow maximally between the heat sink fins 121. Through this, the cooling efficiency may be maximized.

The scroll housing 100 may be provided in a shape in which three sides are open. Specifically, the front, rear, and lower sides may be provided to open. Here, the front and rear are provided to be the same as the front and rear of the refrigerator 1.

The scroll housing 100 may include a first outlet 105, a second outlet 106 and a third outlet 107.

The first outlet 105 is an open rear side of the scroll housing 100 and is provided to communicate with the first discharge port 12*a* of the main body 10. Accordingly, the first outlet 105 of the scroll housing 100 may be provided to form the first flow path P1.

The second outlet 106 is an open lower side of the scroll housing 100 and is provided to communicate with the second discharge port 15*a* of the main body 10. Accordingly, the second outlet 106 of the scroll housing 100 may be provided to form the second flow path P2.

The third outlet 107 is an open front side of the scroll housing 100 and is provided to communicate with the third discharge port 60*a* of the main body 10. More specifically, the third outlet 107 is provided to communicate with a space between the circuit board cover 13 and the seating plate 61. Accordingly, the third outlet 107 of the scroll housing 100 may be provided to form the third flow path P3.

A guide rib 108 may be formed at a rear side of the scroll housing 100 adjacent to the first outlet 105. Through the guide rib 108, air flowing through the first flow path P1 may be smoothly moved to the first discharge port 12*a*.

The scroll housing 100 may include a plurality of coupling portions 109. The coupling portion 109 of the scroll housing 100 may be provided to be coupled to the blowing fan cover 15. In the refrigerator 1 according to the disclosure, the coupling portion 109 of the scroll housing 100 is illustrated in four units thereof, but the number thereof may not be limited thereto.

Referring to FIG. 12, the length from the center C of the scroll housing 100 to the round portion 103 may be provided as a first length d1. In addition, a minimum length from the center C of the scroll housing 100 to the linear portion 102 may be provided as a second length d2. The minimum length from the center C of the scroll housing 100 to the linear portion 102 may refer to a length obtained by drawing a straight line vertically from the center C toward the linear portion 102.

In the scroll housing 100 according to the disclosure, the first length d1 may be provided to be longer than the second length d2. In particular, the difference between the first length d1 and the second length d2 may be provided to be less than or equal to 12% of the first length d1. When the difference between the first length d1 and the second length d2 is greater than 12% of the first length d1, the area of the inlet 101 is excessively reduced, and the flow rate may be drastically reduced. Therefore, when the difference between the first length d1 and the second length d2 is within 12% of the first length d1, flow noise may be most effectively reduced.

A specific shape and a specific direction of a washing machine have been described above with reference to the accompanying drawings, but the present disclosure may be variously modified and changed by those skilled in the art, and the modifications and changes should be interpreted as being included in the scope of the present disclosure.

What is claimed is:

1. A refrigerator comprising:

a main body including:

a suction port; and a plurality of discharge ports;

a storage compartment formed inside the main body;

a thermoelectric element to supply cold air to the storage compartment while discharging generated heat, the thermoelectric element including:

a heat absorbing portion to supply cold air to the storage compartment; and a heat generating portion to discharge the generated heat;

a heat sink below the heat generation portion and configured to receive the heat discharged from the heat generating portion of the thermoelectric element;

a blowing fan below the heat sink and configured to cool the heat sink by introducing external air through the suction port to pass through the heat sink, the blowing fan to have the air passed through the heat sink to pass through the blowing fan and to discharge the air passed through the blowing fan through the plurality of discharge ports; and a scroll housing to accommodate the blowing fan therein, the scroll housing including:

an inlet through which the air passed through the heat sink flows to the blowing fan;

a linear portion forming a boundary of the inlet, the linear portion is formed perpendicular to a flow direction of the air passing through the heat sink, and the air passed through the blowing fan is respectively discharged in multiple directions through the plurality of discharge ports.

2. The refrigerator of claim 1, wherein the scroll housing further includes a round portion connected to the linear portion, and the linear portion and the round portion are to form the inlet.

3. The refrigerator of claim 2, wherein each of the linear portion and the round portion is provided as a pair.

4. The refrigerator of claim 2, wherein a length from a center of the inlet to the round portion is a first length, a minimum length from the center of the inlet to the linear portion is a second length, and a difference between the first length and the second length is smaller than or equal to 12% of the first length.

5. The refrigerator of claim 1, wherein the heat sink includes a plurality of heat dissipation fins, and the linear portion is formed in a direction perpendicular to a direction in which the heat dissipation fins are disposed.

6. The refrigerator of claim 1, wherein the suction port is provided as a pair and the pair of suction ports are formed at opposite side surfaces, respectively, of a lower portion of the main body.

7. The refrigerator of claim 1, wherein the scroll housing further includes a heat sink support rib extending upward from an upper surface of the scroll housing.

8. The refrigerator of claim 1, wherein the linear portion is formed to be convexly bent upward to guide an air flow to the blowing fan.

9. The refrigerator of claim 1, wherein the blowing fan is a centrifugal fan.

10. The refrigerator of claim 1, wherein the plurality of discharge ports includes a first discharge port formed on a rear surface of the main body, and a second discharge port formed on a bottom surface of the main body.

11. The refrigerator of claim 10, wherein the scroll housing includes:

a first outlet formed at a rear side of the scroll housing to communicate with the first discharge port; and a second outlet formed on a lower side of the scroll housing to communicate with the second discharge port, and wherein the air introduced into the inlet of the scroll housing is discharged through the first outlet and the second outlet and then to the first discharge port and the second discharge port, respectively.

12. The refrigerator of claim 1, wherein the heat sink is a first heat sink and the blowing fan is a first blowing fan, the refrigerator further comprising:

a second heat sink above the thermoelectric element to receive cold air; and a second blowing fan above the second heat sink to diffuse cold air into the storage compartment, and wherein the first heat sink is below the thermoelectric element.

13. The refrigerator of claim 1, further comprising:

a circuit board mounting portion disposed in front of the scroll housing; and a seating plate coupled to the circuit board mounting portion, wherein a circuit board is accommodated in the circuit board mounting portion.

14. The refrigerator of claim 13, wherein the main body further includes a circuit board cover forming a part of a bottom surface and below the circuit board mounting portion, the scroll housing further includes an outlet formed at a front side, and air from the outlet of the scroll housing flows into a space between the seating plate and the circuit board cover to cool heat generated from the circuit board.

15. The refrigerator of claim 14, wherein the plurality of discharge ports include a first discharge port and a second discharge port, and the circuit board mounting portion further includes a third discharge port formed on a lateral side to discharge the air having cooled the circuit board.

16. A refrigerator comprising:

a main body having a suction port through which external air is introduced;

a plurality of discharge ports including:

a first discharge port formed on a rear surface of the main body;

a second discharge port formed on a bottom surface of the main body; and a third discharge port formed on a front lower portion of the main body a storage compartment formed in the main body;

a thermoelectric element having heat exchanged to supply the storage compartment with cold air, the thermoelectric element including:

a heat absorbing portion to supply cold air to the storage compartment; and a heat generating portion to discharge the generated heat;

a heat sink below the heat generation portion to receive the heat discharged from the heat generating portion of the thermoelectric element;

a blowing fan below the heat sink to cool the heat sink by introducing external air through the suction port to pass through the heat sink, the blowing fan to have the air passed through the heat sink to pass through the blowing fan and to discharge the air passed through the blowing fan through the plurality of discharge ports; and a scroll housing to accommodate the blowing fan therein, the scroll housing having a plurality of discharge flow paths formed therein to allow the air passed through the blowing fan to flow, wherein:

the first flow path is configured to allow the air passed through the blowing fan to flow to the first discharge port;

the second flow path is configured to allow the air passed through the blowing fan to flow to the second discharge port, and the third flow path is configured to allow the air passed through the blowing fan to flow to the third discharge port to cool a circuit board to be accommodated in front of the scroll housing.

17. The refrigerator of claim 16, wherein the refrigerator further includes a seating plate on which the circuit board is seated, the seating plate in front of the scroll housing, the main body further includes a circuit board cover below the seating plate while forming a part of the bottom surface, and air flows from the scroll housing to a space between the seating plate and the circuit board cover to form the third flow path.

18. The refrigerator of claim 17, wherein the scroll housing includes an outlet on a front side thereof to form the third flow path.

19. The refrigerator of claim 18, wherein the scroll housing includes:

an inlet formed on an upper surface thereof to allow the air passed through the heat sink to flow to the blowing fan therethrough; and a linear portion forming a boundary of the inlet, the linear portion extending in a direction perpendicular to a flow direction of air passing through the heat sink.

20. The refrigerator of claim 19, wherein the scroll housing further includes a round portion connected to the linear portion to form the inlet, in which a length from a center of the inlet to the round portion is a first length, a minimum length from the center of the inlet to the linear portion is a second length, and a difference between the first length and the second length is smaller than or equal to 12% of the first length.

* * * * *